US005175390A

United States Patent [19]

Peretz et al.

[11] Patent Number: 5,175,390

[45] Date of Patent: Dec. 29, 1992

[54] DELAY DETONATOR

[75] Inventors: Matityahu Peretz, Kfar Saba; Adrian Klecner, Tel Aviv; Elyahu Shachar, Holon; Elisha Amramy, Kfar Saba; Felix Schieber, Bat Yam, all of Israel

[73] Assignee: Israel Military Industries Ltd., Israel

[21] Appl. No.: 805,005

[22] Filed: Dec. 10, 1991

[30] Foreign Application Priority Data

Dec. 16, 1990 [IL] Israel ..... 96684

[51] Int. Cl.[5] ..... F42B 3/16

[52] U.S. Cl. ..... 102/202.13

[58] Field of Search ..... 102/202.13, 204, 202.14, 102/202, 275.3

[56] References Cited

U.S. PATENT DOCUMENTS

| | | | |
|---|---|---|---|
| 3,078,799 | 2/1963 | Kabik | 102/202.13 |
| 3,351,011 | 11/1967 | Montesi | 102/202.13 |
| 3,712,217 | 1/1973 | Little et al. | 102/388 |
| 3,967,553 | 7/1976 | Keraus et al. | 102/364 |
| 4,841,856 | 6/1989 | Gislev et al. | 102/202.13 |
| 5,054,396 | 10/1991 | Grommes et al. | 102/204 |

FOREIGN PATENT DOCUMENTS

| | | | |
|---|---|---|---|
| 324371 | 7/1989 | European Pat. Off. | 102/202.13 |
| 426145 | 10/1947 | Italy | 102/204 |

*Primary Examiner*—Stephen M. Johnson
*Attorney, Agent, or Firm*—Nixon & Vanderhye

[57] ABSTRACT

A detonator comprising a generally tubular housing and including therewithin a plurality of detonation material stages, each formed with a recess for receiving a succeeding stage.

8 Claims, 1 Drawing Sheet

DELAY DETONATOR

FIELD OF THE INVENTION

The present invention relates to detonators generally and more particularly to detonators having a delayed detonation feature.

BACKGROUND OF THE INVENTION

Various types of detonators are known in the art. There is known, for example, European Published Patent Application 324,371 which shows a multi-stage detonator providing a detonation delay of up to ten seconds which includes multiple layers of slow burning material, the first including a conical recess.

SUMMARY OF THE INVENTION

The present invention seeks to provide a detonator having a delay feature which provides improved performance as compared with prior art delay detonators. Such improved performance includes a longer delay time, a capability of continuous burning under difficult working conditions such as high spin rates and low temperatures, and a delay element including various delay compositions, which together produce a non-uniform burning rate, pressed with a specially shaped pin.

In accordance with a preferred embodiment of the present invention, there is provided a detonator comprising a generally tubular housing and including therewithin a plurality of detonation material stages, each formed with a recess for receiving a succeeding stage.

In accordance with a preferred embodiment of the present invention, each of the recesses formed in a stage comprises a multi-step recess. Preferably, each multi-step recess is symmetrical about a longitudinal axis of the tubular housing.

In accordance with a preferred embodiment of the present invention, the delay tube is composed of stainless steel due to the suitable heat transfer properties of the metal.

In accordance with a preferred embodiment of the present invention, the detonator comprises a cylindrical housing, a first end cap located within the cylindrical housing at a first end thereof, a delay primer stage disposed within the end cap, an ignition powder stage disposed within the end cap, an intermediate composition stage disposed within the cylindrical housing and having a forward facing recess formed therein, a plurality of delay composition stages disposed within the cylindrical housing and each having a rearward facing protrusion seated within a corresponding forward facing recess of an adjacent stage and having a forward facing recess, a second end cap located within said cylindrical housing at a second end thereof and a delay booster stage disposed within the end cap.

More specifically in accordance with a preferred embodiment of the present invention, the detonator comprises a cylindrical housing, a first end cap located within the cylindrical housing at a first end thereof, a delay primer stage disposed within the end cap, an ignition powder stage disposed within the end cap, an intermediate composition stage disposed within the cylindrical housing and having a first forward facing recess formed therein, a first tungsten delay composition stage disposed within the cylindrical housing and having a first rearward facing protrusion seated within the first forward facing recess and having a second forward facing recess, a second tungsten delay composition stage disposed within the cylindrical housing and having a second rearward facing protrusion seated within the second forward facing recess and having a third forward facing recess, a third tungsten delay composition stage disposed within the cylindrical housing and having a third rearward facing protrusion seated within the third forward facing recess and having a fourth forward facing recess, a fourth tungsten delay composition stage disposed within the cylindrical housing and having a fourth rearward facing protrusion seated within the fourth forward facing recess and having a fifth forward facing recess, a fifth tungsten delay composition stage disposed within the cylindrical housing and having a fifth rearward facing protrusion seated within the fifth forward facing recess, a second end cap located within said cylindrical housing at a second end thereof and a delay booster stage disposed within the end cap.

BRIEF DESCRIPTION OF THE DRAWINGS

The present invention will be understood and appreciated more fully from the following detailed description, taken in conjunction with the drawing in which.

DETAILED DESCRIPTION OF A PREFERRED EMBODIMENT

Figure 1:
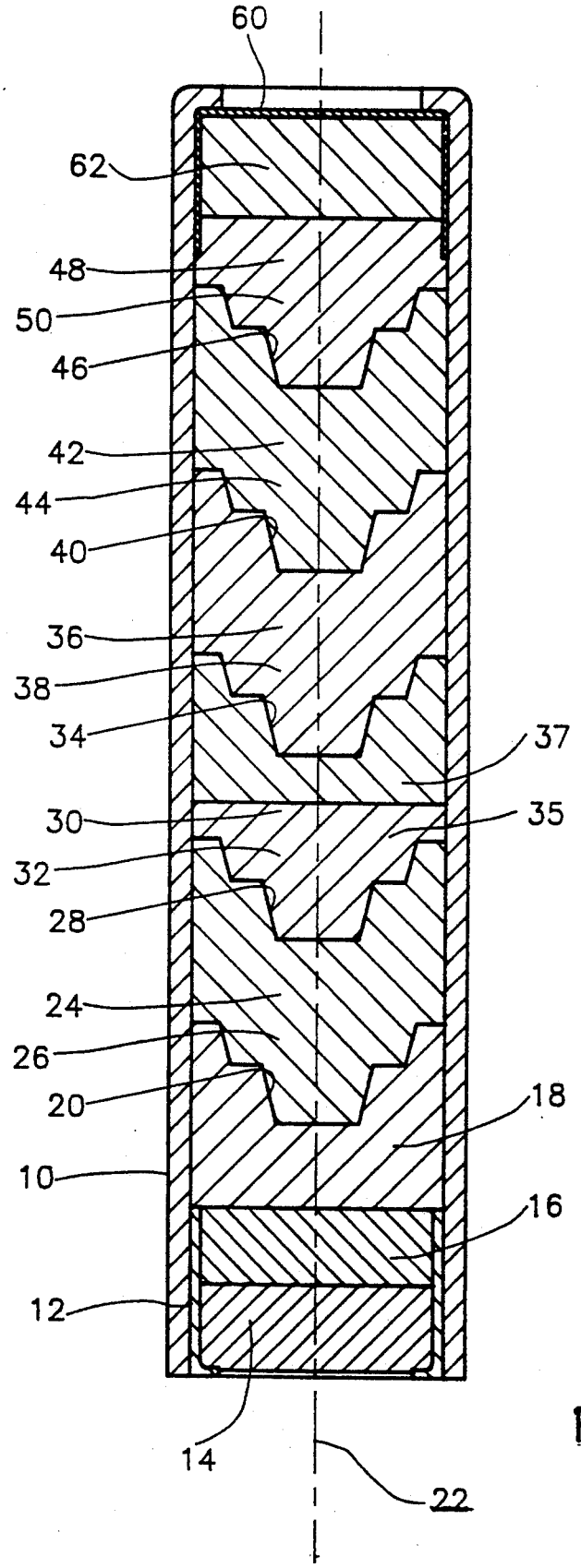
FIG. 1 is a sectional illustration of a detonator constructed and operative in accordance with a preferred embodiment of the invention.

Reference is now made to FIG. 1 which illustrates a detonator constructed and operative in accordance with a preferred embodiment of the present invention. The present invention has a characteristic delay of minimally 14 seconds and typically 17 seconds at a temperature of 63° C., while being capable of continuous burning at high spin rates of the order of 12,000 rpm.

As shown in FIG. 1, there is provided a detonator including a cylindrical housing 10 typically formed of stainless steel. Disposed at a first end of the cylindrical housing 10 is a first end cap 12, typically formed of aluminum and sealed with respect to the cylindrical housing 10 typically by a sealing lacquer.

Disposed within the end cap 12 are a delay primer stage 14, typically comprising initiator, and an ignition powder stage 16, typically comprising a gasless ignition powder, such as composition A1A.

Adjacent to ignition powder stage 16 there is provided an intermediate composition stage 18, typically formed of an intermediate composition having a high calorific value and a burning rate much lower than that of A1A. Stage 18 is preferably formed with a first forward facing recess 20 formed therein. Recess 20 is preferably rotationally symmetric about the longitudinal axis 22 of the cylindrical housing 10 and is formed with plural steps, typically two in number, as shown.

A first tungsten delay composition stage 24 is disposed within the cylindrical housing and is configured to have a first rearward facing protrusion 26 corresponding to and fully seated within the first forward facing recess 20 and to have a second forward facing recess 28. Stage 24 typically comprises a fast burning delay composition.

A second tungsten delay composition stage 30 is disposed within the cylindrical housing 10 and is configured to have a second rearward facing protrusion 32 corresponding to and fully seated within the second forward facing recess 28 and to have a third forward facing recess 34. Stage 30 typically comprises two subsections 35 and 37, as shown, subsection 35 including a medium rate delay composition and subsection 37 including a slow rate delay composition.

A third tungsten delay composition stage 36 is disposed within the cylindrical housing 10 and is configured to have a third rearward facing protrusion 38 corresponding to and fully seated within the third forward facing recess 34 and to have a fourth forward facing recess 40. Stage 36 typically comprises a slow rate tungsten delay composition.

A fourth tungsten delay composition stage 42 is disposed within the cylindrical housing 10 and is configured to have a fourth rearward facing protrusion 44 corresponding to and fully seated within the fourth forward facing recess 40 and to have a fifth forward facing recess 46. Stage 42 typically comprises a slow rate tungsten delay composition.

A fifth tungsten delay composition stage 48 is disposed within the cylindrical housing 10 and is configured to have a fifth rearward facing protrusion 50 corresponding to and fully seated within the fifth forward facing recess 46. Stage 48 typically comprises a slow rate tungsten delay composition.

The delay compositions may be produced in accordance with one or more of the following specifications: MIL-D-82710(OS), May 12, 1989; MIL-T-23132(WEP), Dec. 12, 1961; MIL-T-23132A(AS); MIL-C-48141(AR), Aug. 4, 1986 or similar specifications.

A second end cap 60, typically formed of aluminum, is located within the cylindrical housing 10 at a second end thereof. The cylindrical wall of the second end cap 60 extends inwardly of the cylindrical housing 10 to partially enclose stage 48. Disposed within second end cap 60 is a delay booster stage 62, typically comprising lead azide RD 1333.

The end cap 60 is sealed with respect to the cylindrical housing 10 by phenol-formaldehyde varnish.

It will be appreciated that the detonator of the present invention provides increased reliability as compared to prior art detonators due to the increase in contact area between the layers of delay material caused by the recesses and protrusions. This increase in contact allows a decrease in the diameter of the delay tube without sacrificing reliability.

Other factors contributing to increased reliability are the orientation of the layers of delay material and the gradual passage from layers with a fast burning rate to layers with a slow burning rate.

It will be noted that the detonator of the present invention is operative even in conditions of temperatures as low as −46° C., spin rates of the order of 12,000 rpm and in a direction which causes a centrifugal force to develop opposite the direction of burning.

It will be appreciated by persons skilled in the art that the present invention is not limited by what has been particularly shown and described hereinabove. Rather the scope of the present invention is defined only by the claims which follow:

We claim:

1. A detonator comprising a generally tubular housing and including therewithin a plurality of detonation material stages arranged to be ignited sequentially, said plurality of detonation material stages being formed with multi-step protrusions which are seated in correspondingly shaped recesses formed in preceding adjacent ones of said plurality of detonation material stages.

2. A detonator according to claim 1 and wherein each said multi-step protrusion is symmetrical about a longitudinal axis of the tubular housing.

3. A detonator according to claim 2 and wherein said multi-step protrusions each include a plurality of sections each of generally truncated conical configuration.

4. A detonator according to claim 1 and wherein said multi-step protrusions each include a plurality of sections each of generally truncated conical configuration.

5. A detonator comprising:

a cylindrical housing;

a first end cap located within the cylindrical housing at a first end thereof;

a delay primer stage disposed within the first end cap;

an ignition powder stage disposed within the first end cap;

an intermediate composition stage disposed within the cylindrical housing said intermediate composition stage being configured to define a forward facing recess having an opening facing away from said first end cap;

a plurality of delay composition stages disposed within the cylindrical housing, at least one of said plurality of delay composition stages having a rearward facing protrusion seated within a corresponding forward facing recess of an adjacent one of said plurality of delay composition stages;

a second end cap located within said cylindrical housing at a second end thereof; and a delay booster stage disposed within the second end cap.

6. A detonator according to claim 5 and wherein said protrusions each include a plurality of sections each of generally truncated conical configuration.

7. A detonator comprising:

a cylindrical housing;

a first end cap located within the cylindrical housing at a first end thereof;

a delay primer stage disposed within the end cap;

an ignition powder stage disposed within the end cap;

an intermediate composition stage disposed within the cylindrical housing and having a first forward facing recess formed therein;

a first tungsten delay composition stage disposed within the cylindrical housing and having a first rearward facing protrusion seated within the first forward facing recess and having a second forward facing recess;

a second tungsten delay composition stage disposed within the cylindrical housing and having a second rearward facing protrusion seated within the second forward facing recess and having a third forward facing recess;

a third tungsten delay composition stage disposed within the cylindrical housing and having a third rearward facing protrusion seated within the third forward facing recess and having a fourth forward facing recess;

a fourth tungsten delay composition stage disposed within the cylindrical housing and having a fourth rearward facing protrusion seated within the fourth forward facing recess and having a fifth forward facing recess;

a fifth tungsten delay composition stage disposed within the cylindrical housing and having a fifth rearward facing protrusion seated within the fifth forward facing recess;

a second end cap located within said cylindrical housing at a second end thereof; and a delay booster stage disposed within the second end cap.

8. A detonator according to claim 7 and wherein said second tungsten delay composition stages comprises two substages including a first substage including a relatively fast delay composition and a second substage including a relatively slow delay composition.

* * * * *